United States Patent [19]

Goebel et al.

[11] Patent Number: 4,502,670

[45] Date of Patent: Mar. 5, 1985

[54] GAS HOOK-UP TO A LADLE

[75] Inventors: Gunther R. Goebel, Grampian; Richard G. Hall, Kylertown, both of Pa.

[73] Assignee: Allied Corporation, Morris Township, Morris County, N.J.

[21] Appl. No.: 576,290

[22] Filed: Feb. 2, 1984

[51] Int. Cl.[3] ..... C21C 5/48

[52] U.S. Cl. ..... 266/220; 266/217; 266/265

[58] Field of Search ..... 266/217–224, 266/265–270, 287

[56] References Cited

U.S. PATENT DOCUMENTS

| | | | |
|---|---|---|---|
| 84,335 | 11/1868 | Absterdam | 266/218 |
| 333,286 | 12/1885 | Davy | 266/224 |
| 688,186 | 12/1901 | Lynn et al. | 266/218 |
| 1,780,693 | 11/1930 | Yazel | 285/64 |
| 3,214,804 | 11/1965 | Saccomano | 266/217 |
| 3,633,898 | 1/1972 | Josefsson et al. | 266/220 |
| 4,392,636 | 7/1983 | Clumpner | 266/265 |

*Primary Examiner*—M. J. Andrews
*Assistant Examiner*—Robert L. McDowell
*Attorney, Agent, or Firm*—Paul Y. Yee; Gerhard H. Fuchs

[57] ABSTRACT

The invention provides an apparatus for selectively connecting a gas supply to a vessel employed to contain molten metal. Generally stated, the apparatus includes a sealer plate connected to an external portion of the vessel to receive the gas and direct it into a fluid conduit that is in fluid communication with a selected interior portion of the vessel. A seal holder disposed in approximate alignment with the sealer plate receives the gas from the gas supply and directs it toward the sealer plate. A spacing mechanism interposed between the seal holder and the sealer plate maintains a selected spaced distance therebetween and delimits the side walls of a substantially sealed gas conduit chamber when the sealer plate and the seal holder simultaneously contact opposite end portions of the side walls defined by the spacing means. The conduit chamber is thereby configured to conduct the gas directed from the seal holder toward and into the sealer plate. Additionally, the spacing mechanism is moveable laterally along a contacting, substantially planar surface of the sealer plate or the seal holder while still maintaining the conduit chamber in operative condition. A force mechanism resiliently urges the seal holder toward the sealer plate to provide sealing-type contact against the interposed spacing mechanism and maintain the substantially sealed gas conduit chamber.

10 Claims, 3 Drawing Figures

GAS HOOK-UP TO A LADLE

DESCRIPTION

BACKGROUND OF THE INVENTION

1. Field of the Invention

The invention relates to an apparatus for selectively connecting a gas supply to a vessel employed to contain molten metal. In particular, the invention relates to a mechanism for selectively connecting a supply of inert gas to a ladle employed to process molten steel.

2. Description of the Prior Art

In the processing of molten metal, such as iron and steel, an inert gas is typically forced through porous plug elements located in the bottom or side walls of a holding vessel; e.g. a ladle; to agitate the metal and provide and a more homogenuous volume. Gas bubbles also helps to remove impurities from the melt volume and carry them to the surface of the melt. Once the metal is processed, the vessel holding the melt is tilted or otherwise moved to pour the molten metal for further processing or for actual casting of metal articles. During this procedure it has been necessary to selectively connect and disconnect the gas supply from the ladle.

Conventional mechanisms for connecting a gas supply to a metal processing ladle have been disclosed in U.S. Pat. No. 84,335 to Absterdam; U.S. Pat. No. 688,186 to Lynn, et al.; U.S. Pat. No. 3,633,898 to Josefsson, et al.; U.S. Pat. No. 3,214,804 to Saccomano; and U.S. Pat. No. 1,780,693 to Yazel.

Conventional gas connection mechanisms, such as those disclosed in the above patents, require relatively precise positioning to adequately mate the corresponding ends of the connection mechanisms. Thus, when a ladle is repeatedly moved and repositioned, the gas connections may not reliably reconnect to deliver gas to the ladle. Additionally, the connection mechanisms are vulnerable to damage and have employed excessive numbers of sliding seals that are susceptible to wear and leakage.

SUMMARY OF THE INVENTION

The invention provides an apparatus for selectively connecting a gas supply to a vessel employed to contain molten metal. Generally stated, the apparatus includes a sealer plate means connected to an external portion of the vessel for receiving the gas and directing it into a fluid conduit that is in fluid communication with a selected interior portion of the vessel. A seal holder means is disposed in approximate alignment with the sealer plate to receive the gas from the gas supply and direct it toward the sealer plate. Spacing means interposed between the sealer holder means and the sealer plate means maintains a selected space distance therebetween and delimits the side walls of a substantially sealed gas conduit chamber when the sealer plate means and the seal holder means simultaneously contact opposite end portions of the side walls defined by the spacing means. The chamber is thereby configured to conduct the gas directed from the seal holder means toward and into the sealer plate means. Additionally, the spacing means is moveable laterally along a contacting, substantially planar surface of the sealer plate means or the seal holder means while still maintaining the conduit chamber in operative condition. A force means resiliently urges the seal holder means toward the sealer plate means to provide sealing-type contact against the interposed spacing means and maintain the substantially sealed gas conduit chamber.

The mechanism can advantageously be remotely located from the associated porous plug elements. This allows adjustment or movement of the porous plug elements without affecting the alignment of the connect mechanism. No manual hook-up connections are required since automatic connection occurs when the metal processing vessel is set into approximate position. Precise alignments between mating parts of the device are not required because the device of the invention tolerates large lateral offsets in alignment. In addition, the configuration minimizes the number of moveable, sliding seals and thereby reduces leaks and maintenance.

Thus, the invention provides an efficient and reliable connection mechanism which provides automatic hook-up and tolerates substantial lateral offsets between the ladle gas inlet and the outlet of the gas source. Additionally, the mechanism minimizes wear and leakage of the gas seals within the connection mechanism.

BRIEF DESCRIPTION OF THE DRAWINGS

The inventor will be more fully understood and further advantages will become apparent when reference is made to the following detailed description of the preferred embodiment of the invention and the accompanying drawings in which.

DESCRIPTION OF THE PREFERRED EMBODIMENTS

In the processing of molten metal, a gas is typically bubbled through the metal to agitate it and provide a homogeneous melt. The bubbled gas also helps carry impurities from the melt volume to the melt surface. Preferrably the gas is an inert gas, such as nitrogen or argon.

Figure 1:
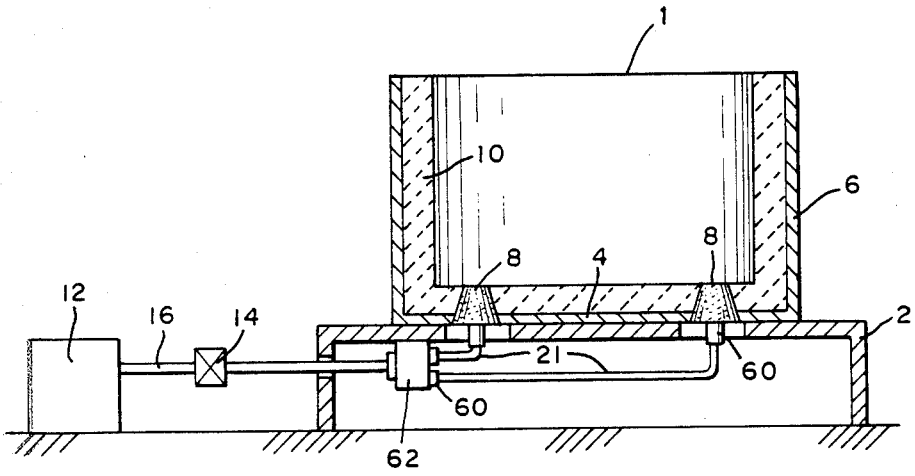
FIG. 1 shows a schematic representation of a ladle connected to a source of inert gas.

FIG. 1 shows a schematic representation of a gas supply connected to a holding vessel to bubble gas through the melt of molten metal being processed therein. Typically, the vessel is a ladle 1 adapted to contain and hold the molten metal. A pedestal means 2 supports the ladle, and a lining 10 of a suitable high temperature refractory material, such as refractory brick, is disposed along the inner surface of ladle 1 to isolate the ladle from the heat of the melt. A least one, and preferrably several porous plug elements 8 are located in the ladle bottom and extend through lining 10. The porous plugs connect to gas conduits 21 with suitable couplings 60 and are employed to direct gas into a selected interior portion of the ladle. A gas supply 12 directs gas through gas conduit 16, through control valve 14 and into fitting 62, which, in turn, directs the gas into conduits 21. Valve 14 regulates the gas flow through conduit 16 and into the ladle.

After the molten metal is processed in ladle 1, the melt is poured from the ladle. To accomplish this, conduits 21 must be physically disconnected from either porous plugs 8 or fitting 62. Typically, the disconnections are done manually in an inefficient, time consuming process. Then when ladle 1 is readied to process another melt, porous plugs 8 must be reconnected to the gas supply. Again, this is typically an inefficient, time-consuming manual process.

The present invention significantly improves the gas line hook-up operation by providing an automatic connection/disconnection mechanism that selectively connects the gas supply to the vessel.

Figure 2:
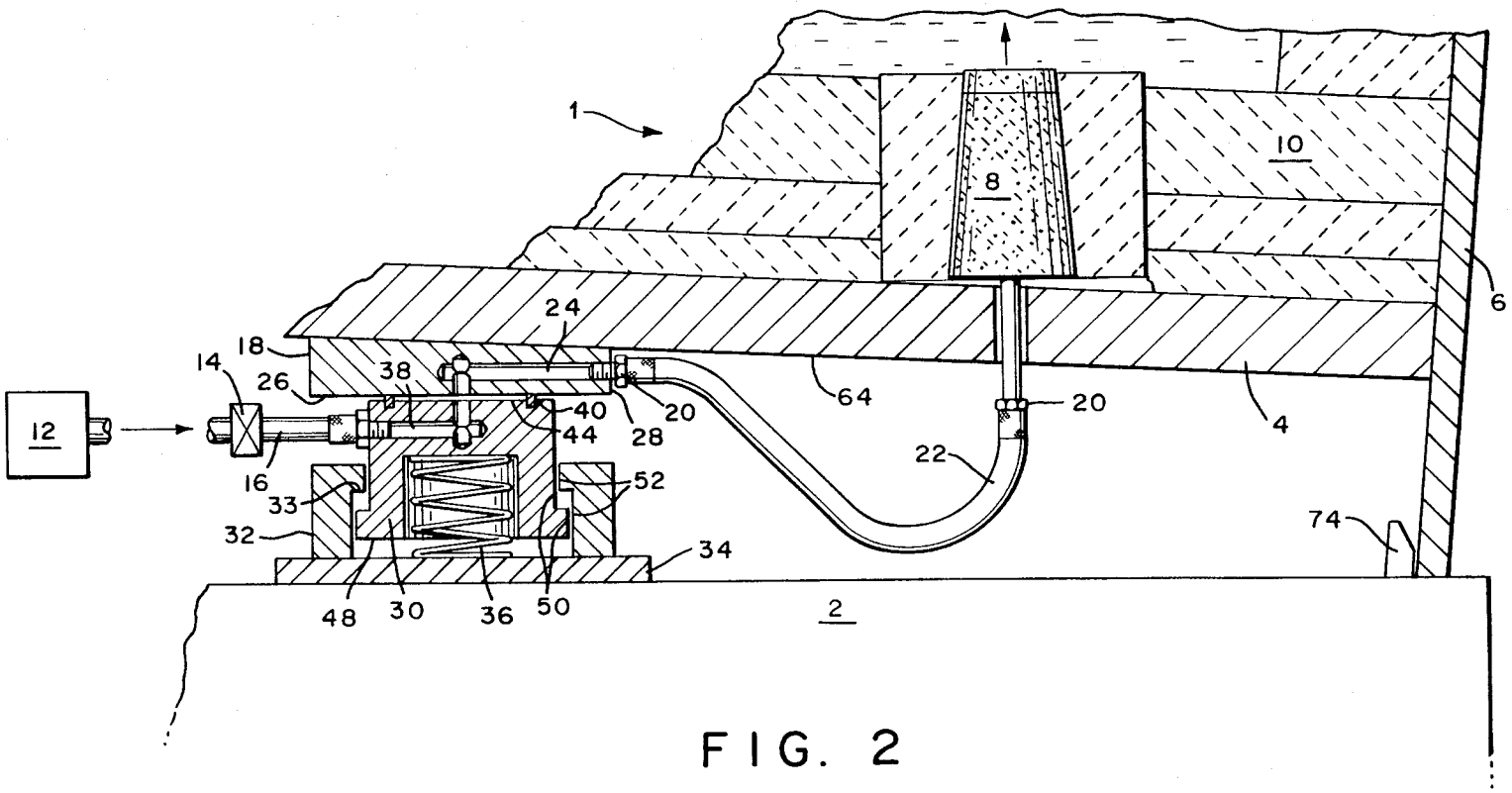
FIG. 2 shows a cross-sectional, side elevational view of the connection mechanism between a gas source and the ladle.
Figure 3:
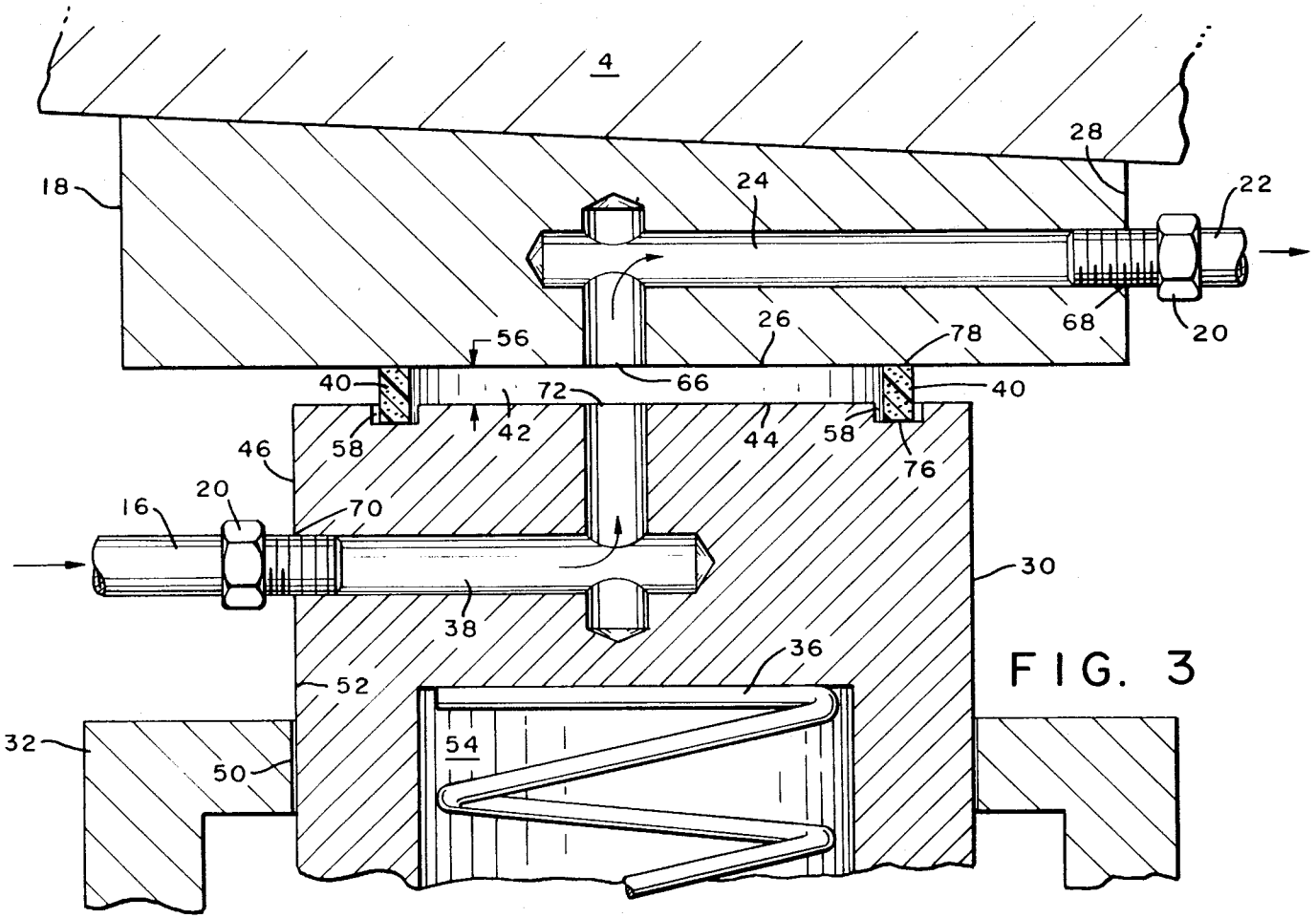
FIG. 3 shows a fragmentary, cross-sectional view of the sealing portion of the connection mechanism.

As shown in FIGS. 2 and 3, the mechanism includes a sealer plate member 18 connected to an external bottom portion of the vessel, such as bottom surface 64 of ladle 1, to receive gas and direct it into fluid conduit 22 which, in turn, is in fluid communication with a selected interior portion of ladle 1. A seal holder means, such as seal holder 30 is disposed in approximate alignment with sealer plate 18 to receive gas from the gas supply 12 and direct it toward sealer plate 18. Spacing means 40 is interposed between seal holder 30 and sealer plate 18 to maintain a selected, spaced distance therebetween and to delimit the side walls of a substantially sealed gas conduit chamber 42 when sealer plate 18 and seal holder 30 simultaneously contact opposite end portions of the side walls defined by spacing means 40. The gas conduit chamber is thereby configured to conduct the gas directed from seal holder 30 toward and into sealer plate 18. Additionally, spacing means 40 is moveable laterally along a contacting, substantially planar surface of either sealer plate 18 or seal holder 30 while still maintaining conduit chamber 42 in operative condition. Force means, such as spring 36 or a pneumatic cylinder containing a compressible gas (not shown), resiliently urges seal holder 30 toward sealer plate 18 to provide sealing-type contact with the interposed spacing means 40 to maintain the substantially sealed conduit chamber 42.

Referring to FIG. 2, ladle 1 has a bottom 4 and sides 6 constructed to contain and hold molten metal. At least one conventional porous plug means 8 is located in the ladle bottom to direct gas into the ladle. The porous plug 8 is generally composed of a ceramic material and configured to allow passage of gas but block the flow of liquid metal. Sealer plate 18 connects to an external surface 64 of ladle bottom 4, preferably at a location remote from the porous plugs. This arrangement allows maintenance of the porous plugs without disturbing the connection mechanism.

Referring to FIG. 3, sealer plate 18 has a gas passage 24 therethrough that provides fluid communication from an inlet opening 66 to an outlet opening 68. Inlet opening 66 is located in a substantially flat face portion 26 of sealer plate 18, and is configured to receive gas directed thereto. Outlet opening 68 is located in a selected outlet portion of sealer plate 18, such as side portion 28. Gas conduit 22 interconnects between sealer plate outlet opening 68 and porous plug 8 and directs gas from sealer plate 18 to the porous plug. Preferably, conduit 22 is a flexible hose.

Sealer holder 30 is disposed in approximate alignment with sealer plate 18 to direct gas toward inlet 66 of the sealer plate. The seal holder has a gas passage therethrough which provides fluid communication between outlet opening 72 located in a face portion 44 and inlet opening 70 located in a selected outlet portion of the seal holder, such as side portion 46. In the shown configuration, seal holder face portion 44 is positioned in facing relation to the corresponding sealer plate face portion 26 and in approximate alignment therewith. Also, seal holder outlet 72 is in approximate alignment with sealer plate inlet 66.

Spacing means 40 is constructed to be interposed between seal holder 30 and sealer plate 18 to maintain a selected spaced distance 56 therebetween. The spacing means is also configured as a continuous member which delimits the side walls of a substantially sealed gas conduit chamber 42 when sealer plate face portion 26 and seal holder face portion 44 simultaneously contact against opposite end portions 76 and 78 of the side walls defined by spacing means 40. Thus, sealer plate face portion 26 and seal holder face portion 44 form the end walls of chamber 42. Thusly configured, chamber 42 receives gas from seal holder outlet opening 72 and conducts into sealer plate inlet opening 66.

Preferably, spacing means 40 is an annular ring-shaped member retained in a matching annular recess 58 formed in seal holder face 44. Spacing means 40 should be composed of a material resistant to high temperatures and capable of providing an effective gas seal at its contact areas with sealer plate 18 and seal holder 30. For example, spacing means 40 may be composed of a high temperature elastomer, such as "FIBERFAX" elastomer manufactured by Carborundum.

While the drawings show spacing means 40 retained on seal holder 30, it is readily apparent that spacing means could be connected or otherwise retained against sealer plate 18 to move therewith and provide equivalent spacing and sealing effect.

While sealer plate face portion 26 and seal holder face portion 44 are shown as substantially flat planar faces, it is readily apparent that either face may be curved concave or convex, as desired. For example, where spacing means 40 is retained in seal holder 30, sealer plate face portion 26 may be flat and seal holder face portion 44 may be concave within the area bounded by spacing means 40 to thereby define a larger volume for chamber 42 that has less resistence to gas flow. Similarly, when spacer means 40 is retained in sealer plate 18, seal holder face portion 44 maybe flat and sealer plate face portion 26 may be concave. In either configuration, it is readily apparent that the spacing means will be moveable laterally along a contacting, substantially planar surface while still maintaining conduit chamber 42 in operative condition.

A force means, such as spring 36, resiliently urges seal holder 30 toward sealer plate 18 to provide sealing type contact against the interposed spacer means 40 and to maintain the substantially sealed gas conduit chamber 42. Alternative force means include pneumatic cylinders or actuators which employ a compressible gas and are constructed and arranged to urge seal holder 30 toward sealer plate 18.

The connection mechanism of the invention can tolerate lateral offsets of sealer plate 18 with respect to seal holder 30 of several inches. To assure repeatable location of sealer plate 18 within the allowable tolerance, however, guide means such as guide brackets 74 connected to ladle pedestal 2, are arranged to suitably position ladle 1 and locate sealer plate 18 into approximate alignment with seal holder 30.

In a preferred embodiment, a guide retainer means 32 guides and restricts the movements of seal holder 30. With reference to FIG. 2, seal holder 30 is generally cylindrical in shape. Retainer 32 is disposed about seal holder 30 and configured to slidably engage a side surface, such as surfaces 50 of seal holder 30, against a mating corresponding side surface of retainer 32, such as surfaces 52. This configuration operates to guide the axial, lengthwise movements of seal holder 30 toward and away from sealer plate 18. Additionally, a flange portion 48 is rigidly connected to seal holder 30 to further guide and limit the lengthwise movements thereof. Flange portion 48 at least intermittently contacts a radially extending seal holder lip portion 33, thereby limiting the lengthwise movement of seal holder 30 toward sealer plate 18. A base portion 34 of retainer means 32 connects the retainer means to ladle pedestal 2 at a selected location to hold seal holder 30 in approximate alignment with sealer plate 18.

During the metal processing operation, ladle 1 is placed onto pedestal 2 and guided into selected position by guide brackets 74. In the selected position, sealer plate 18 is located in approximate alignment with seal holder 30. Initially, spring 36 resiliently urges seal holder to its upward limit of travel as determined by the contact of seal holder flange 48 against retainer flange 33. As ladle 1 is lowered and guided down onto pedestal 2, face portion 26 of sealer plate 18 contacts spacing means 40 which has previously been retained in contact with the aligned and oppositely positioned face portion 44 of seal holder 30. Seal holder 30 moves downward, guided by bearing surfaces 50 and 52 of seal holder 30 and retainer 32, respectively. Spring 36 compresses and provides a force which maintains sealing contact of both sealer plate surface 26 and seal holder 44 against spacing means 40 interposed therebetween even if ladle 1 moves slightly during the processing of the molten metal.

Chamber 42, as defined by spacing means 40 interposed in sealing contact with sealer plate 18 and seal holder 30, eliminates the need for precise alignment between seal holder outlet 72 and sealer plate inlet 66 during the hook-up of the gas supply to the ladle. Even though outlet 72 and inlet 66 maybe misaligned by a lateral offset of three inches or more, conduit chamber 42 advantageously allows the required gas flow from seal holder passage 38 into sealer plate passage 24 and through the chamber volume defined by spacing means 40 and the gap 56. To provide the required gas flow, it is only necessary that seal holder outlet 72 and sealer plate inlet 66 are both positioned in fluid communication with conduit chamber 42. Since the spacing means is moveable laterally along the contacting, substantially planar surface 26 of sealer plate 18, the spacing means still maintains the conduit chamber in operative condition even though gas passage openings 72 and 66 are laterally offset by several inches.

Since the apparatus has only one slideable seal member, there is less potential for leakage and wear. As a result, maintenance requirements are significantly reduced.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for selectively connecting a gas supply to a vessel employed to contain molten metal, comprising:

(a) a sealer plate means connected to an external portion of said vessel for receiving said gas and directing it into a fluid conduit that is in fluid communication with a selected interior portion of said vessel;

(b) sealer holder means disposed in an approximate alignment with said sealer plate for receiving said gas from said gas supply and directing it toward said sealer plate;

(c) spacing means interposed between said seal holder means and said sealer plate means for maintaining a selected, spaced distance therebetween and for delimiting the side walls of a substantially sealed gas conduit chamber when said sealer plate means and said seal holder means simultaneously contact opposite end portions of the side walls defined by said spacing means, said chamber thereby configured to conduct said gas directed from said seal holder means toward and into said sealer plate means, and said spacing means capable of being offset laterally along a contacting, substantially planar surface of said sealer plate means or of said seal holder means while still maintaining said conduit chamber in operative condition; and (d) force means for resiliently urging said seal holder means toward said sealer plate to provide sealing-type contact against said interposed spacing means and maintain said substantially sealed gas conduit chamber.

2. An apparatus as recited in claim 1, wherein said spacing means is comprised of an annular-shaped member composed of a heat resistant elastomer and disposed in a matching recess formed into a face portion of said seal holder, said seal holder face portion being in facing relation to said sealer plate and in approximate alignment therewith.

3. An apparatus as recited in claim 1, wherein said spacing means is comprised of an annular-shaped elastomeric member retained in a face portion of said sealer plate, said sealer plate face portion being in approximate facing alignment with said seal holder means.

4. An apparatus as recited in claim 1, wherein said force means is comprised of a spring arranged to contact and resiliently urge said seal holder means toward said sealer plate means.

5. An apparatus as recited in claim 1, wherein said force means is comprised of a pneumatic cylinder containing a compressable gas which is arranged to resiliently urge said seal holder means toward said sealer plate means.

6. An apparatus as recited in claim 1, wherein said sealer plate means has a gas passage formed there through which provides fluid communication from an inlet opening located in a face portion of said sealer plate means to an outlet opening located in an outlet portion of said sealer plate means, said sealer plate inlet opening being constructed to receive said gas directed thereto, and said sealer plate outlet opening being constructed to direct said gas into said fluid conduit.

7. An apparatus as recited in claim 1, wherein said seal holder means has a gas passage therethrough which provides fluid communication from an inlet opening located in an inlet portion of said seal holder means to an outlet opening in a face portion of said seal holder means, said seal holder inlet opening being constructed to receive gas from said gas supply and said seal holder outlet opening being constructed to direct said gas toward a sealer plate inlet opening.

8. An apparatus as recited in claim 1, further comprising a retainer means for guiding and limiting the axial, lengthwise movement of said seal holder means.

9. An apparatus as recited in claim 8, wherein said retainer means comprises:

(a) a radially extended flange portion connected to a peripheral surface of said seal holder; and (b) a guide retainer disposed about the seal holder flange portion to slideable engage a side surface of said seal holder against a mating side surface of said guide retainer to guide the lengthwise movements of the seal holder, and having a radially extending lip portion which at least intermittently contacts said seal holder flange portion to limit the lengthwise movement of said seal holder means.

10. An apparatus for selectively connecting a gas supply to a vessel employed to process molten metal, comprising:

(a) a vessel having the bottom and sides constructing to contain said molten metal;

(b) at least one porous plug means located in a selected portion of said vessel for directing said gas into a selected interior portion of said vessel;

(c) sealer plate means connected to an external surface of said vessel bottom at a location remote from said porous plug means, said plate means having a gas passage therethrough which provides fluid communication from an inlet opening located in a face portion of said sealer plate to an outlet opening located in an outlet portion of said sealer plate;

(d) a gas conduit for directing said gas from said sealer plate to said porous plug means, said gas conduit being interconnected between said sealer plate outlet opening and said porous plug means;

(e) seal holder means disposed in approximate alignment with said sealer plate means for directing said gas received from said gas supply toward the inlet opening in said sealer plate means, said seal holder means having a gas passage therethrough which provides a fluid communication between a holder outlet opening located in a face portion of said seal holder and a inlet opening located in an inlet portion of said seal holder;

(f) spacing means, comprised of an annular-shaped elastomeric member interposed between said seal holder means and said sealer plate means, for providing a selected spaced distance between said sealer plate face portion and said seal holder face portion, and for delimiting the side walls of a substantially gas conduit chamber which conducts said gas directed from said seal holder outlet opening toward into said sealer plate inlet opening when said sealer plate face portion and said seal holder face portion simultaneously contact against opposite end portions of the side walls defined by said spacing means;

(g) a radially extending flange portion connected to a peripheral surface of said seal holder means for guiding and limiting the lengthwise movement of the seal holder means, and said spacing means capable of being offset laterally along a contacting, substantially planar surface of said sealer plate means or of said seal holder means while still maintaining said conduit chamber in operative condition.

(h) a guide retainer for guiding and restricting the movements of said seal holder means, said guide retainer disposed about the seal holder flange portion to slideably engage a side surface of said seal holder means against a mating side surface of said retainer to thereby guide the lengthwise movements of the seal holder, and having a fixed radially extending lip portion, which at least intermittently contacts said seal holder flange portion to limit the lengthwise of said seal holder means;

(i) spring means disposed adjacent to said seal holder means for resiliently urging said seal holder means toward said sealer plate to provide sealing-type contact against said interposed spacing means to maintain said substantially sealed gas conduit chamber; and (j) guide means for guiding said vessel to position the sealer plate in approximate alignment with said seal holder means.

* * * * *